United States Patent [19]

Birch

[11] Patent Number: 4,808,034

[45] Date of Patent: Feb. 28, 1989

[54] SYSTEM AND METHOD FOR SECURING A MARINE RISER TO A FLOATING STRUCTURE

[75] Inventor: Andrew D. Birch, The Hague, Netherlands

[73] Assignee: Shell Oil Company, Houston, Tex.

[21] Appl. No.: 141,172

[22] Filed: Jan. 6, 1988

[30] Foreign Application Priority Data

Apr. 16, 1987 [GB] United Kingdom ..... 8709230

[51] Int. Cl.[4] ..... E21B 17/01

[52] U.S. Cl. ..... 405/195; 166/367

[58] Field of Search ..... 405/169, 195, 224; 166/341, 343, 344, 345, 350, 359, 367; 175/5, 7

[56] References Cited

U.S. PATENT DOCUMENTS 3,605,415 9/1971 Mohlman ..... 166/367 X
4,182,584 1/1980 Panicker et al. ..... 405/195
4,529,334 7/1985 Ortloff ..... 166/367 X
4,657,439 4/1987 Petersen ..... 166/350 X
4,695,191 9/1987 Wagstaff ..... 405/195

FOREIGN PATENT DOCUMENTS 2397084 3/1979 France ..... 166/350

*Primary Examiner*—David H. Corbin

[57] ABSTRACT

A system and method are disclosed for securing a flexible marine riser to a floating structure. The system comprises a guide ring which is slidably secured to the riser at a location below the riser top. During installation of the riser, the guide ring is pulled into a guide ring receptor located near the bottom of the structure while the riser top rests upon the guide ring. Subsequently, the riser top is lifted from the guide ring while the riser is pulled through the guide ring, whereafter the riser top is connected to a terminal end of a conduit system on the structure.

11 Claims, 2 Drawing Sheets

SYSTEM AND METHOD FOR SECURING A MARINE RISER TO A FLOATING STRUCTURE

BACKGROUND OF THE INVENTION

The invention relates to a system and method for securing a flexible marine riser to a floating structure.

Floating production systems are becoming more cost effective than fixed bottom-supported structures as oil and gas production operations progress into deeper waters. These floating production systems may consist of semi-submersible vessels, turret tankers, single-point mooring systems, tension leg platforms or any other type of floating structure. In a typical application of a floating production system, a number of underwater wells are connected to production equipment mounted on the floating structure via one or more flexible marine risers. Each flexible riser may comprise a flexible conduit such as a flowline or electrical cable, or a combination of multiple flowlines and electrical cables. The flexible risers may extend in a straight vertical direction from the water-bottom to the floating structure or have a catenary shape. At present there are two systems available for connecting a flexible marine riser to a floating structure.

In the first system, the riser is connected at its upper end to a riser receptor located at an underwater location near the bottom of the structure. As can be imagined, a problem exists of how to hook up a riser to a receptor at a submerged location since it requires utilization of remotely actuated pull-in equipment and/or the assistance of divers. In the other available riser connection system, the riser is connected to a receptor at the deck of the floating structure. In that case the flowlines and cable connections can be made in the dry, but the riser must pass through the splash-zone at the water surface and a large spacing is required between the riser and hull of the structure to avoid collision between the hull and riser in rough weather conditions.

SUMMARY OF THE INVENTION

A primary object of the present invention is to remedy the above drawbacks, and to provide an improved riser connection system and method which are simple and economical to use and which enable flowline and cable connections to be made up in the dry, at a location where the riser connection is not subject to bending forces.

A method according to the invention thereto comprises the steps of:

arranging a guide ring around the riser at a location below a stop shoulder which forms part of connector means at the upper end of the riser, said guide ring comprising an opening having a width which is larger than the width of the riser but smaller than the width of the stop shoulder;

securing a guide ring receptor to the floating structure at a location below a terminal end of a conduit system on the floating structure;

pulling the guide ring into engagement with the guide ring receptor, said stop shoulder being located on top of the guide ring during the pulling operation;

securing the guide ring to the guide ring receptor, hoisting the connector means from the guide ring to said terminal end of the conduit system, while allowing the riser to slide through said opening; and connecting the riser connector means to said terminal end of the conduit system.

A riser connection system according to the invention comprises:

riser connector means arranged at the upper end of the riser for connecting the riser to a terminal end of a conduit system on the floating structure, said riser connector means comprising a stop shoulder having a larger width than the riser;

a guide ring surrounding the riser at a location below the connector means, said guide ring comprising an opening having a width which is larger than the width of the riser but smaller than the width of the stop shoulder;

a guide ring receptor being secured to the floating structure at a location below said terminal end of the conduit system;

means for pulling the guide ring into engagement with a guide ring receptor while the stop shoulder is located on top of the guide ring; and hoist means for raising the riser connector means from the guide ring to said terminal end of the conduit system while allowing the riser to slide through said opening.

The key element in the system according to the invention is the "slip through" guide ring which serves as a means for guiding and anchoring the flexible riser to the floating structure at a location well below the riser top. Preferably the guide ring receptor is connected to the lower end of a vertically oriented protective tube which extends along the hull of the floating structure from a location near the bottom of the structure to above the water surface. In this manner the riser is protected against the action of the waves while the riser connector means at the riser top are located in the dry.

It will be appreciated that a floating structure may comprise a plurality of riser connection systems according to the invention and that each riser connection system may be used to secure one or a plurality of risers to the structure.

BRIEF DESCRIPTION OF THE DRAWINGS

The invention will now be described in greater detail with reference to the accompanying drawings, in which.

DETAILED DESCRIPTION OF THE PREFERRED EMBODIMENTS

Figure 1:
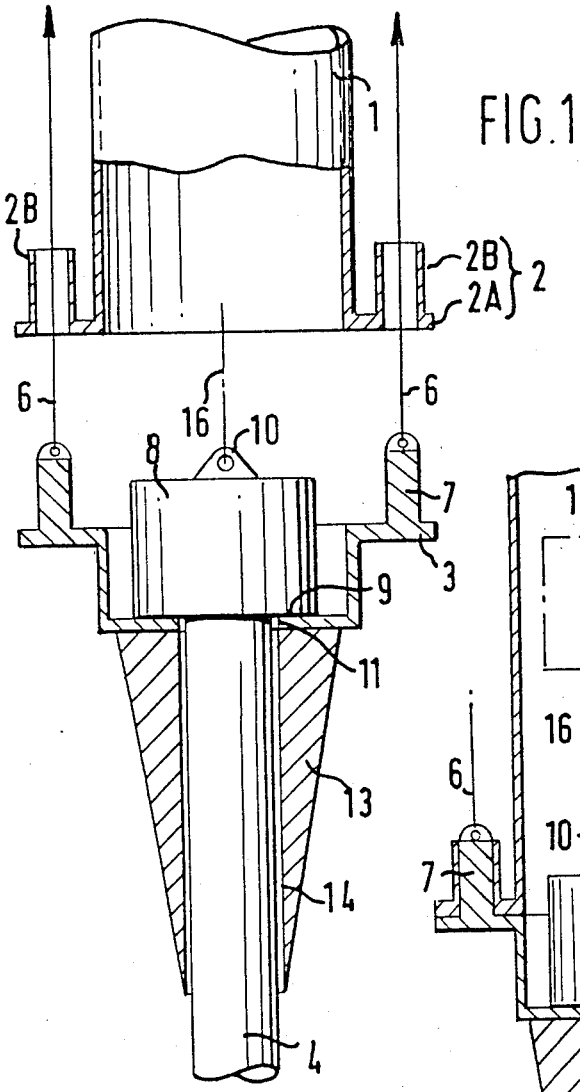
FIG. 1 shows an initial step of a method according to the invention, during which step the guide ring is pulled into a guide ring receptor.

Referring now to FIG. 1, there is shown the lower part of a protective tube 1. The protective tube is rigidly connected to a floating structure (not shown). A guide ring receptor 2 consisting of a flange 2A and two guide tubes 2B is arranged at the lower end of the tube 1.

In the situation shown in FIG. 1 a guide ring 3 carrying the top of a flexible marine riser 4 is pulled towards the guide ring receptor 2 by means of hoisting cables 6 which are connected to a pair of guide posts 7 on the guide ring 3. The cables 6 pass through the guide tubes 2B of the guide ring receptor 2 towards hoisting winches (not shown) mounted at the deck of the floating structure.

At the top of the riser 4 there is arranged a cylindrical riser connector 8 which is provided with a stop shoulder 9 and a hoisting eye 10. The riser 4 itself passes through an opening 11 in the guide ring 3 and through a bend restrictor 13 which is secured below the ring 3. The opening 11 has a width which is slightly larger than the width of the riser 4 but which is smaller than the width of the stop shoulder 9. The bend restrictor 13 consists of a polyurethane tapered collar having a central bore 14 provided with a nylon lining.

As illustrated in FIG. 1, the stop shoulder 9 rests upon the guide ring 3 during the step of pulling the guide ring 3 towards the guide ring receptor 2.

Figure 2:
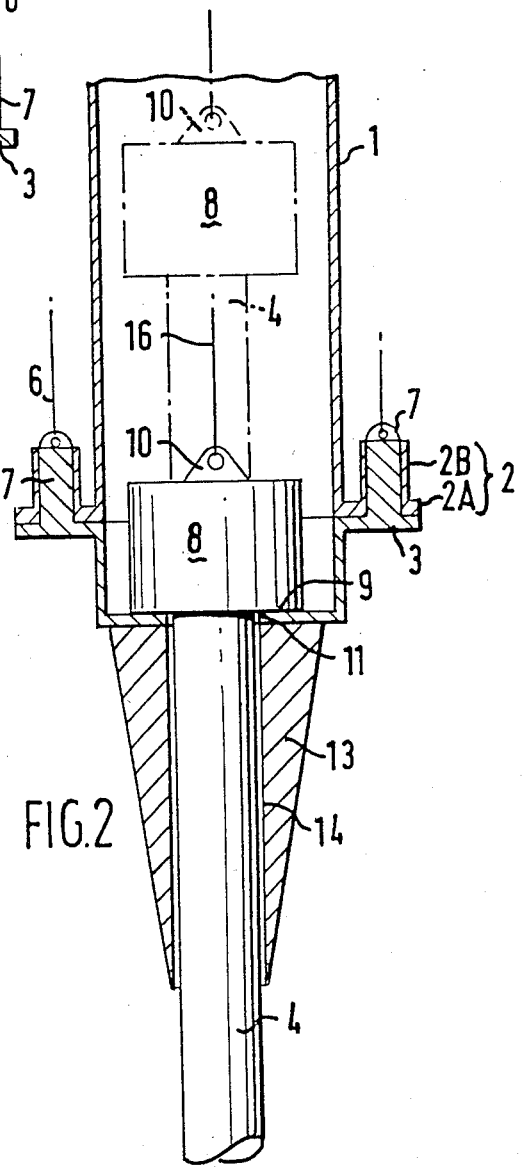
FIG. 2 shows the next step of pulling the flexible riser through the guide ring.

In the situation shown in FIG. 2, the guide ring 3 has been locked to the guide ring receptor 2 while the riser connector 8 is hoisted through the protective tube 1 by means of a hoisting cable 16 which is secured to the hoisting eye 10. As illustrated in phantom lines, the hoisting operation causes the riser connector 8 to be lifted from the guide ring 3 while the riser 4 is pulled in upward direction through the central bore 14 of the bend restrictor and through the opening 11 in the guide ring 3. The hoisting operation is continued until the riser connector 8 has reached a terminal end (not shown) of a conduit system on the structure, which terminal end is located near the top of the protective tube 1. Finally the riser connector 8 is plugged into said terminal end in a manner known in the art.

Figure 3:
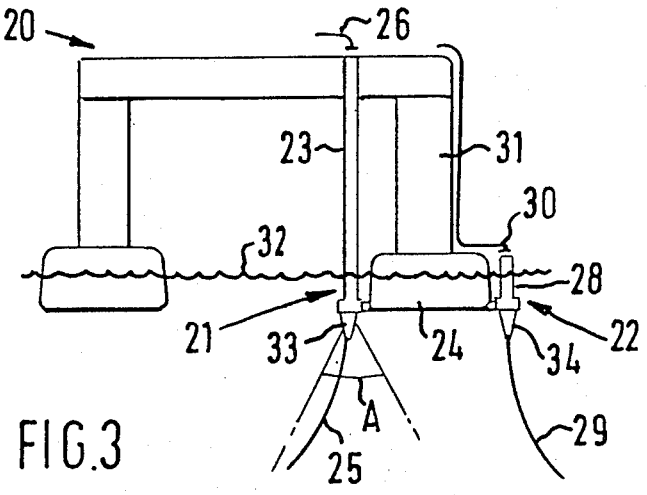
FIG. 3 shows a semi-submersible vessel provided with two riser connector systems according to the invention.

FIG. 3 shows a semi-submersible vessel 20 provided with two riser connector systems 21 and 22 according to the invention.

The first riser connector system 21 comprises a protective tube 23 which extends from the bottom of a floater 24 to the platform deck. The riser 25 passing through the tube 23 is at the upper end thereof connected to a terminal end 26 of a conduit system at the platform deck.

The second riser connector system 22 comprises a protective tube 28 which extends between the bottom and the top of the floater 24. The riser 29 passing through the tube is connected to a terminal end 30 of a conduit system which is fixed to one of the platform legs 31. Said terminal end 30 is located at such a height above the bottom of the floater 23 that, in a deballasted state of the vessel 20, it is located above the waterline 32, but that it is located underwater when the vessel 20 is ballasted.

Each riser connector system 21, 22 is provided with a guide ring/bend restrictor assembly 33, 34, respectively, which allows the riser to sweep within a selected maximum angle A without causing unduely high bending forces in the riser. In each riser connector system 21, 22, the connections between the riser top and the terminal end 26, 30, respectively, of the fixed conduit systems are located at a sufficient distance above the guide ring/bend restrictor assembly so that bending movements in the connections are prevented and the flowline and electrical connectors between the risers and fixed conduit systems can be made up of simple flange and pinbox systems.

Figure 4:
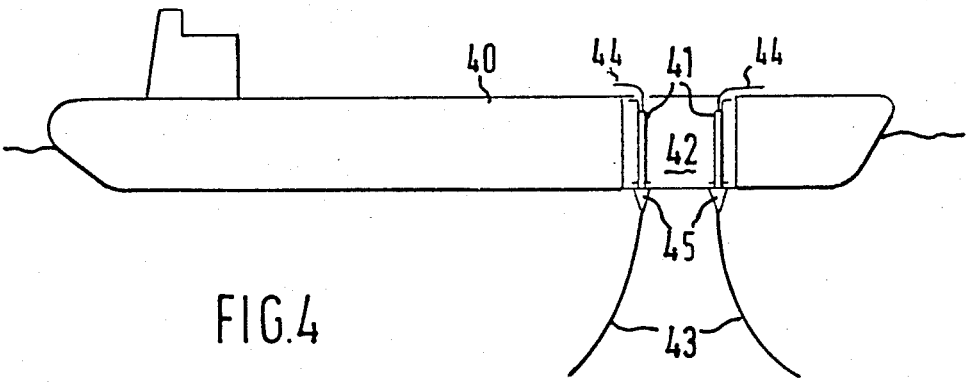
FIG. 4 shows a turret tanker provided with two riser connector systems according to the invention.

FIG. 4 shows a turret tanker 40 provided with two riser connector systems according to the invention. Each connector system comprises a protective tube 41 extending through a moonpool 42 from the bottom to the deck of the tanker. Each riser 43 is connected at the upper end thereof to a terminal end 44 of a conduit system at the deck of the tanker and passes through a guide ring/bend restrictor assembly 45 which is removably connected to the lower end of each protective tube.

Figure 5:
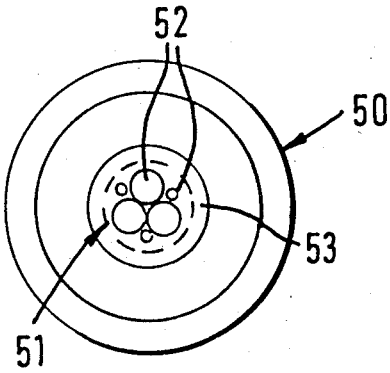
FIG. 5 is a top view of a guide ring having a single opening through which a multibore flexible riser passes.
Figure 6:
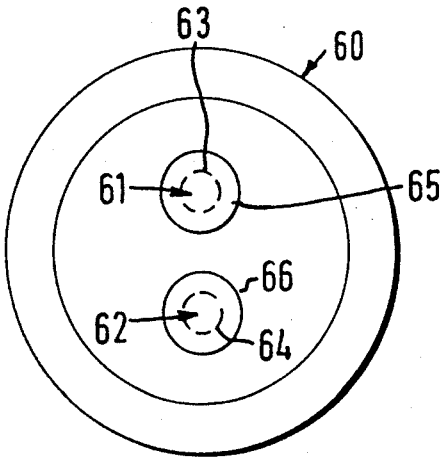
FIG. 6 is a top view of a guide ring having two openings through which singlebore flexible risers pass.

FIGS. 5 and 6 show two alternative guide ring configurations in a riser connector system according to the invention.

The guide ring 50 shown in FIG. 5 is similar to the ring 3 shown in FIGS. 1 and 2. The guide ring 50 comprises a central opening 51 through which a multibore riser 52 is suspended. The riser 52 consists of a bundle of steel or composite flowlines and electrical conduits, and is at the upper end thereof provided with a cylindrical connector 53 for connecting the flowlines and electrical conduits to corresponding fixed flowlines and conduits at the floating structure. Since the construction and operation of multibore connectors is known per se, no detailed description thereof is necessary.

The guide ring 60 shown in FIG. 6 comprises two openings 61, 62 through which single-bore flexible risers 63, 64, respectively, are suspended. Each riser 63, 64 is provided at the upper end thereof with a riser connector 65, 66 having a larger width than the opening 61, 62, thereby allowing the riser connector 65, 66 to rest upon the guide ring 60 while the ring is pulled towards and operatively connected to a guide ring receptor (not shown) at the floating structure in the same manner as described with reference to FIG. 1. After connecting the guide ring 60 to the guide ring receptor, the riser connectors 65, 66 may be hoisted either simultaneously or one by one to flowline ends located above the guide ring receptor in the same manner as described with reference to FIG. 2 while allowing the risers 63, 64 to slide through the openings 61, 62.

It will be appreciated that any desired number of risers may pass through the guide ring shown in FIG. 6, provided that each riser passes through a corresponding opening in a slidable manner.

Furthermore it will be understood that instead of providing the guide ring with a pair of guide posts which can be locked to a pair of corresponding guide tubes as illustrated in FIGS. 1 and 2 any other suitable locking assembly can be used to secure the guide ring to the guide ring receptor.

It will further be understood that many other variations and modifications may be made in the riser connection systems and methods hereinbefore described. Accordingly, it should be clearly understood that embodiments of the riser connection system and method shown in the drawings are illustrative only and are not intended as limitations on the scope of the appended claims.

What is claimed is:

1. A system for securing a flexible marine riser to a conduit system of a floating structure supported on the water surface, the system comprising:

riser connector means arranged at an upper end of the riser for connecting the riser to a terminal end of the conduit system on the floating structure, said riser connector means comprising a stop shoulder having a larger width than the riser;

a guide ring surrounding the riser at a location below the riser connector means, said guide ring comprising an opening having a width which is larger than the width of the riser but smaller than the width of the stop shoulder;

a guide ring receptor being secured to the floating structure at a location below said terminal end of the conduit system;

means for pulling the guide ring into engagement with the guide ring receptor while the stop shoulder is located on top of the guide ring; and hoist means for raising the riser connector means from the guide ring to said terminal end of the conduit system while allowing the riser to slide through said opening.

2. A system in accordance with claim 1, wherein the guide ring receptor is connected to a lower end of a vertically oriented protective tube which is rigidly connected to the floating structure.

3. A system in accordance with claim 2, wherein said protective tube extends from a location near the bottom of the floating structure to a location above the water surface.

4. A system in accordance with claim 2, wherein said hoist means comprises a hoisting cable which passes through said protective tube.

5. A system in accordance with claim 2, wherein the floating structure is a turret tanker and said protective tube is arranged in a moonpool formed in the hull of said tanker.

6. A system in accordance with claim 2, wherein the floating structure is a semi-submersible platform and said protective tube extends from a submerged floater to the platform deck.

7. A system in accordance with claim 1, wherein said guide ring carries a downwardly tapered flexible collar having a central bore which is arranged vertically below said opening.

8. A system in accordance with claim 1 wherein said riser is a multibore riser including a plurality of flowlines and electrical conduits.

9. A system in accordance with claim 1, wherein the guide ring further comprises at least one other opening which surrounds another riser at a location below a riser connector means which is arranged at the top of said another riser, said hoist means being suitable to raise said riser connector means of each of said risers simultaneously to terminal ends of the conduit system on the floating structure while allowing the risers to slide through said openings.

10. A method for securing a flexible marine riser to a floating structure, the method comprising:

arranging a guide ring around the riser at a location below a stop shoulder which forms part of connector means at the upper end of the riser, said guide ring comprising an opening having a width which is larger than the width of the riser but smaller than the width of the stop shoulder;

securing a guide ring receptor to the floating structure at a location below a terminal end of a conduit system on the floating structure;

pulling the guide ring into engagement with the guide ring receptor, said stop shoulder being located on top of the guide ring during the pulling operation;

securing the guide ring to the guide ring receptor, hoisting the connector means from the guide ring to said terminal end of the conduit system, while allowing the riser to slide through said opening; and connecting the riser connector means to said terminal end of the conduit system.

11. A method in accordance with claim 10, further comprising the steps of connecting a vertically oriented protective tube to the guide ring receptor and to the platform and hoisting the riser connector means through said protective tube to a location close to said terminal end of the conduit system.

* * * * *